United States Patent [19]

Spivey

[11] 3,957,208

[45] *May 18, 1976

[54] SPRAY GUN

[76] Inventor: Allen Spivey, 506 E. Johnson St., Douglas, Ga. 31533

[ * ] Notice: The portion of the term of this patent subsequent to Oct. 8, 1991, has been disclaimed.

[22] Filed: Sept. 30, 1974

[21] Appl. No.: 510,604

Related U.S. Application Data

[63] Continuation-in-part of Ser. No. 411,828, Nov. 1, 1973, Pat. No. 3,840,184.

[52] U.S. Cl. ..... 239/372; 239/415; 239/528

[51] Int. Cl.[2] ..... B05B 7/04

[58] Field of Search ..... 239/398, 414, 415, 527, 239/528, 576, 372

[56] References Cited

UNITED STATES PATENTS

| | | | |
|---|---|---|---|
| 2,027,103 | 1/1936 | Johnson et al. | 239/528 |
| 2,717,806 | 9/1955 | Dale | 239/528 X |
| 3,709,438 | 1/1973 | Johnson | 239/527 X |
| 3,758,039 | 9/1973 | Wagner | 239/528 X |
| 3,861,596 | 1/1975 | Nathan et al. | 239/528 X |

*Primary Examiner*—John J. Love
*Assistant Examiner*—Michael Mar
*Attorney, Agent, or Firm*—Jones, Thomas & Askew

[57] ABSTRACT

A spray gun is disclosed for use by professional hair stylists in spraying hair spray or hair setting substances on the hair of customers. The spray gun includes a rigid barrel and handle and a pivotal trigger which opens and closes needle valves mounted in the handle. One needle valve controls an air conduit while the other needle valve controls a liquid conduit and the needle valve of the air conduit is opened before and closed after the needle valve of the liquid conduit.

4 Claims, 4 Drawing Figures

SPRAY GUN

CROSS-REFERENCE

This application is a continuation-in-part of copending application Ser. No. 411,828, filed Nov. 1, 1973, now U.S. Pat. No. 3,840,184.

BACKGROUND OF THE INVENTION

Large amounts of hair sprays are dispensed by hair stylists in beauty parlors, etc., where the large number of customers and large quantity of hair spray consumed makes it desirable to have a large and easily accessible supply of hair spray. In the past, hair spray has been dispensed from aerosol cans, aspirators, and other hand-held, relatively small quantity devices. The smaller, temporary hair spray devices are expensive for the hair stylist since the use of large quantities of the hair spray requires the use of a large number of containers for the hair spray as well as the hair spray itself, and the hair stylists is therefore required to spend a substantial amount on purchasing disposable containers. Although refillable portable containers are available, it is inconvenient for the hair stylist to interrupt the hair styling function to refill a container and it is desirable for the stylist to have a power spray instead of a hand-powered spray pump.

While various spray gun assemblies with large capacity liquid tanks and a source of air pressure have been developed and used in the past for the purpose of dispensing hair spray and other sprays such as paints, etc., the prior art devices have been either very expensive and therefore not desired by or accessible to most hair stylists or the devices have been cheaply constructed and not durable. The spray gun devices used in spraying paint, etc., usually comprise a high pressure spray system for dispensing large quantities of paint and heavy hardware to handle the pressures and quantities desired. The less expensive spray gun systems used in styling hair usually have included lightweight cheaply formed parts that are unreliable in use and deteriorate rapidly.

SUMMARY OF THE INVENTION

Briefly described, the present invention comprises a spray gun system for use by professional hair stylists and others. The spray gun is of lightweight, durable and reliable construction and is fabricated from inexpensive parts. The spray gun includes a handle and a barrel, a nozzle at the end of the barrel, and a pair of conduits extending from the nozzle, through the barrel, and through the handle. Needle valves are positioned in each conduit and function to open and close the conduits in response to the pivotal movement of a trigger connected to the handle. The needle valve in the conduit which is connected to a source of air pressure is arranged to open before and close after the needle valve in the conduit connected to the liquid. The moving parts of the spray gun are fabricated from durable, lightweight material, such as polyvinyl chloride, and the spray gun functions to clear its nozzle before and after each spraying operation by the sequential movements of the needle valves.

Thus, it is an object of the present invention to provide a spray gun for the purpose of dispensing hair spray and other sprays and which is durable, lightweight, reliable, inexpensive and which is capable of dispensing a large quantity of hair spray without refilling.

Other objects, features and advantages of the present invention will become apparent upon reading the following specification, when taken in conjunction with the accompanying drawing.

DESCRIPTION OF A PREFERRED EMBODIMENT

Figure 1:
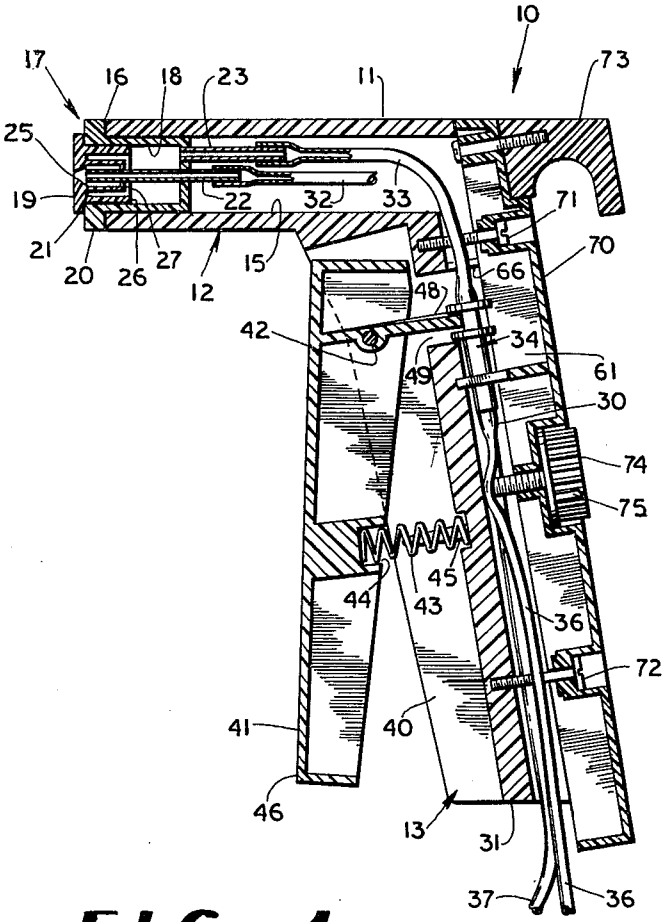
FIG. 1 is a side cross sectional view of the spray gun.

Referring now in more detail to the drawing, in which like numerals indicate like parts throughout the several views, FIG. 1 discloses spray gun 10 which includes a body 11 having a barrel 12 and handle 13. Handle 13 extends at an angle from barrel 12 and is sized and shaped so as to be suitably received in the palm of the hand of an operator. The barrel 12 defines an internal bore 15 that functions as a passage. Bore 15 opens through the distal end 16 of barrel 12, and nozzle 17 is insertd in bore 15. Nozzle 17 comprises nozzle housing 18 and apertured plug 19. The flange 20 of nozzle housing 18 abuts the end of barrel 12 and the flange 21 of the apertured plug abuts the open end of nozzle housing 18. Liquid conduit 22 extends axially through nozzle housing 18 and terminates at the open end of housing 18, while air conduit 23 opens into nozzle housing 18. Apertured plug 19 includes central nozzle aperture 25 which is coaxial with liquid conduit 22 and concentric collars 26 and 27. Outer collar 26 wedges in the opening of nozzle housing 18, while inner collar 27 surrounds liquid conduit 22. When liquid and air under pressure are in communication with conduits 22 and 23, nozzle 17 functions to aspirate or spray through the aperture 25 in the conventional manner.

Handle 13 includes a slot 30 on its back side which functions as a passage and extends the entire height of the handle and intersects the internal bore 15 of barrel 12. Slot 30 and internal bore 15 together function as a passage which extends from the distal end 16 of barrel 12 to the butt end 31 of handle 13. Barrel tubes 32 and 33 are each connected at one of their ends to conduits 22 and 23. Needle valves 34 and 35 are connected at one of their ends to the other ends of tubes 32 and 33. Handle tubes 36 and 37 are each connected at one of their ends to needle valves 34 and 35. The conduits 22 and 23 of nozzle 17 together with barrel tubes 32 and 33, needle valves 34 and 35 and handle tubes 36 and 37 function as first and second conduit means 38 and 39.

Handle 13 forms a slot on its front face beneath barrel 12 at 40, and trigger 41 is pivotally connected adjacent its upper end by pivot pin 42 to handle 13 in slot 40. Coil compression spring 43 is seated in oppositely facing aligned bores 44 and 45 in trigger 41 and handle 13, and spring 43 functions to bias the distal lower end 46 of trigger 41 away from handle 13. Trigger 41 includes a projection 48 that extends through window 49 into slot 30 on the back of handle 13. Projection 48 engages needle valves 34 and 35.

Figure 4:
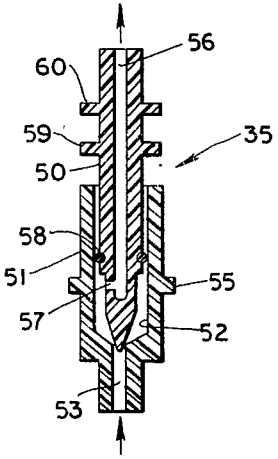
FIG. 4 is a side cross sectional view of one of the needle valves.

As is illustrated in FIG. 4, each needle valve 34 and 35 comprises a needle member 50 and a socket 51.

Socket 51 includes internal bore open at its upper end and a passageway 53 which communicates with the bottom of bore 52. Rectangular external collar 55 surrounds the socket 51. Needle member 50 includes internal passageway 56 and port 57 which communicates with passageway 56 and opens through the body of the needle member near its lower end. O-ring 58 surrounds needle member 50 above port 57, and a pair of spaced apart external collars 59 and 60 extend outwardly from the needle member above socket 51. When needle member 50 is moved in a downward direction so that its tapered lower end engages the bottom of the bore 52, no communication exists between lower passageway 53 of socket 51 and upper passageway 56 of needle member 50. When needle member 50 is moved upwardly so as to be partially withdrawn from socket 51, the bottom of the bore is disengaged by needle member 50 and communication is opened between lower passageway 53 of socket 51, into the internal bore 52 of the socket, through ports 57, and through upper passageway 56. O-ring 58 seals needle member 50 and socket 51 so that there will be no leakage from the socket.

Figure 3:
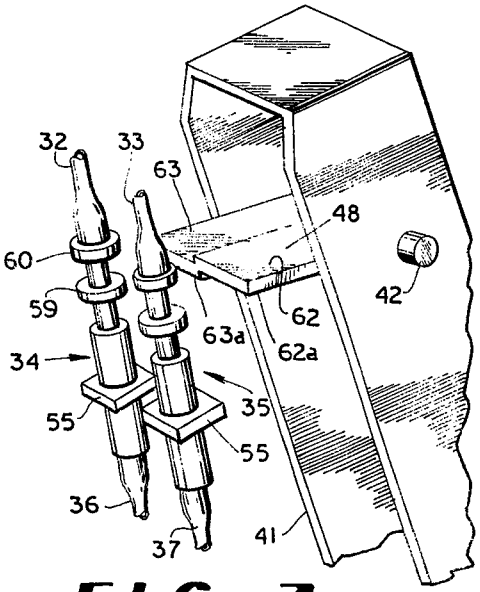
FIG. 3 is a detail illustration of the trigger and needle valves.
Figure 2:
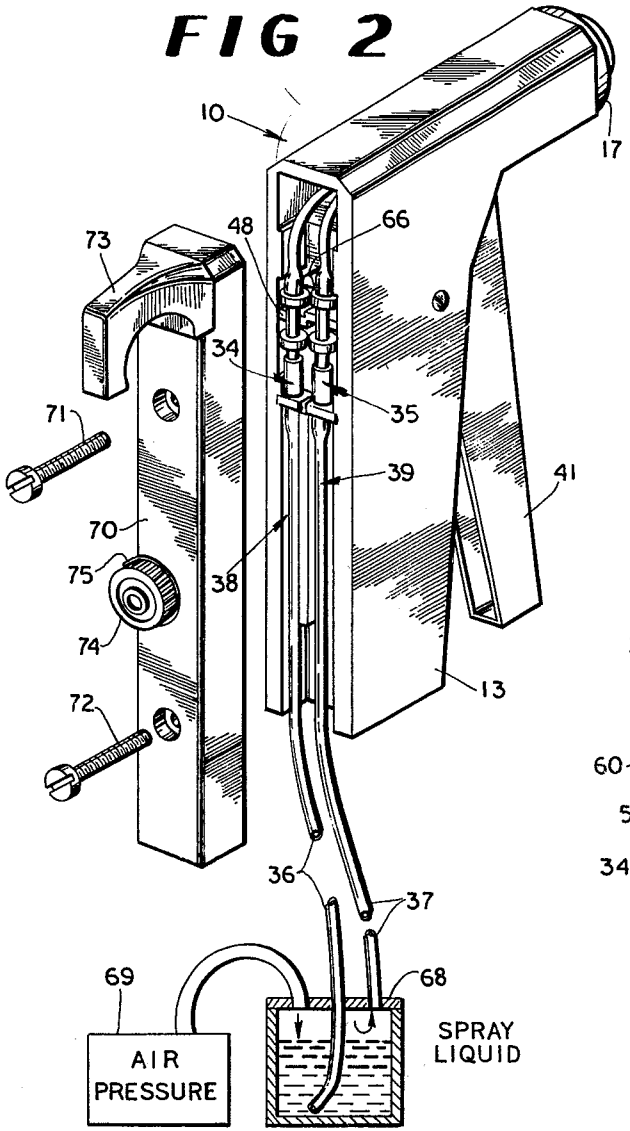
FIG. 2 is a perspective exploded view of the spray gun, with the air pressure and spray liquid containers shown in schematic form.

Needle valves 34 and 45 are positioned in slot 30 of handle 13, with the external collar 55 of the socket 51 being received in transverse slots 61, so that the socket is rigidly mounted within the handle. As is best illustrated in FIG. 3, the projection 48 of trigger 41 extends through window 49 toward engagement with the needle members of both needle valves.

As the handle 13 is held in the hand with slot 30 uppermost and visible, projection 48 has a stepped configuration and is shaped on its upper surface right side with an area 62 which is raised above the level of the area 63 on the left side upper surface. Projection 48 is also shaped on its lower surface left side with an area 62A which is raised above the level of the area 63A on the right side lower surface. Consequently, the projection 48 is shaped so that its upper surface is raised on the right side above the left side and its lower surface is raised on the left side above the right side.

As the handle 13 is assembled, projection 48 is fitted between projections 60 and 59 on needle valves 34 and 35. The right side of the projection 48 fits between the projections 60 and 59 of needle valve 35 and the left side of the projection 48 fits between projections 60 and 59 of needle valve 34. The space between the collars 59 and 60 of both needle valves is the same, so that when trigger 41 is pivoted about its pivot pin 42, projection 48 lifts needle member 50 of needle valve 35 before it will lift the needle member 50 of needle valve 34, thus causing needle valve 35 to open before needle valve 34. Furthermore, when trigger 41 is returned to its original position, projection 48 returns needle member 50 of needle valve 34 to its seat within socket 51 before it returns the needle member 50 of needle valve 35, thus causing needle valve 35 to close after needle valve 34. Consequently, air, through needle valve 34, is propelled first and last through nozzle aperture 25 to remove substances which might clog the aperture.

In an alternative embodiment, a coil compression spring (not shown) is mounted on barrel tube 32 and its lower end engages the collar 60 while its upper end engages spring stop 66 inside the slotted handle 13. Coil compression spring 65 urges needle member 50 of needle valve 34 in a downward direction toward closing engagement with its socket 51. Thus, when trigger 41 is moved against the bias of its spring 43 to pivot projections 48 upwardly, needle valve 35 will open ahead of needle valve 34. When trigger 41 is released and moves with the bias of its spring away from handle 13, coil compression spring 65 urges the needle member 50 of needle valve 34 toward an early closing engagement with its socket 51. The raised area 63A on the lower surface of projection 48 causes needle valve 34 to close before needle valve 35. Thus, projection 48 functions as a valve engaging means which is connected to both of the needle valve means.

The handle tubes 36 and 37 extend through the bottom of the slot 30 of handle 13 and are connected to a liquid spray container 68. Handle tube 36 which is a liquid bearing tube communicates with the lower portion of container 68, while handle tube 37 which is an air bearing tube communicates with the upper portion of the container. A source of air pressure 69, such as a compressor, etc., communicates with the upper portion of container 68. Thus, container 68 functions as a pneumatic displacement pump to displace the liquid in the container downwardly and ultimately in an upward direction through handle tube 36, and the pressure above the liquid in container 68 is in communication with handle tube 37.

In operating the spray gun 10, the operator merely aims the barrel 12 and depresses trigger 41 against the bias of its spring 43. Projection 48 pivots with trigger 41 and first opens needle valve 35. Further depression of trigger 41 subsequently opens needle valve 34. Air flows from container 58 through needle valve 35 and through nozzle 17, and when needle valve 34 is subsequently opened, the flowing air assures that the liquid dispensed from nozzle 17 will be in the form of a fine spray. When trigger 41 is released and its spring 43 biases it away from handle 13, needle valve 34 will close first as caused by the lower raised area in projection 48 to terminate the communication of liquid from container 68 to nozzle 17, and the closing of needle valve 35 will be delayed so that a flow of air is maintained through nozzle 17 for a short period. This functions to clear the nozzle 17 of any liquid.

A closure plate 70 is attached to the back of handle 13 by screws 71 and 72, and hook 73 extends from the upper end of the closure plate and functions as a means for hanging the spray gun from a support. Set screw 74 is threaded through closure plate 70, and its cap is recessed in counterbore 75. Set screw 74 engages and pinches handle tube 36 which is the liquid bearing tube in communication with the liquid in container 68. When the set screw is threaded deeply into the slot and tightly pinches handle tube 36, only a small passageway inside tube 36 is available for the passage of liquid. Thus, a fine constant control is maintained over the quantity of liquid that can be carried by the air from the spray gun.

While this invention has been described in detail with particular reference to preferred embodiments thereof, it will be understood that variations and modifications can be effected within the spirit and scope of the invention as described hereinbefore and as defined in the appended claims.

I claim:

1. A spray gun assembly comprising a body including a barrel and a handle extending at an angle from said barrel, said barrel and handle defining a passage extending in said barrel from its end opposite to said handle and in said handle to its end opposite to said barrel, a nozzle mounted in the passage of said barrel, first and second conduit means each connected at one of its ends to said nozzle and extending through the passage of said barrel and said handle, first and second needle valve means mounted in said first and second conduit means respectively and arranged to selectively open and close said first and second conduit means, each of said needle valve means comprising a socket defining a bore and a needle member movable along its length in a direction into said socket to close the needle valve means and in a direction out of said socket to open the needle valve means, a trigger member pivotally connected at one of its ends to said body with its other end movable toward and away from said handle, spring means arranged to bias said trigger member away from said handle, said trigger member including valve engaging means connected to both of said first and second needle valve means and arranged to move the needle member of each needle valve means out of its socket as the trigger member is moved against the bias of its spring means toward the handle to open said needle valve means and to move the needle member of each needle valve means into its socket as the trigger member is moved with the bias of its spring means away from the handle to close said needle valve means, said valve engaging means comprising a projection having a stepped configuration so as to open said first needle valve means before opening said second needle valve means, and to close said second needle valve means before the closing of said first needle valve means.

2. The spray gun assembly of claim 1 and wherein the socket of each of said first and second needle valve means is rigidly mounted in said handle and the valve engaging means extends into said handle and is connected to said needle members and moves the needle valve members into and out of their sockets in response to the movement of the trigger member.

3. The spray gun assembly of claim 1 and wherein said passage defined in said barrel and handle comprises a bore in said barrel and a groove in said handle intersecting the bore in said barrel, and a closure member connected to said handle about said groove.

4. The spray gun assembly of claim 1 and further including a source of air pressure, a container for spray liquid communicating at its upper end with said source of air pressure, and said first conduit means communicating with the upper end of said container and said second conduit means communicating with the lower end of said container.

* * * * *